US009171533B1

(12) United States Patent
Cuayo

(10) Patent No.: US 9,171,533 B1
(45) Date of Patent: Oct. 27, 2015

(54) BAND DRIVEN ELECTRONIC ORGAN

(71) Applicant: Angel Cuayo, Hollywood, FL (US)

(72) Inventor: Angel Cuayo, Hollywood, FL (US)

( * ) Notice: Subject to any disclaimer, the term of this patent is extended or adjusted under 35 U.S.C. 154(b) by 3 days.

(21) Appl. No.: 14/300,935

(22) Filed: Jun. 10, 2014

(51) Int. Cl.
*G10H 3/06* (2006.01)

(52) U.S. Cl.
CPC ..... *G10H 3/06* (2013.01)

(58) Field of Classification Search
CPC ..... G06F 2203/04112; G06F 3/0325; G06F 3/042; G06F 3/0421; G06F 3/0202; G06F 3/0304; G06F 3/0423; G06F 3/0428; G06F 3/0484; G02B 6/001; G02B 5/18; G02B 6/0038; G02B 6/0045; H04R 23/008; G10H 3/06; G10H 2220/411; G10H 2220/061; G10H 1/055
See application file for complete search history.

(56) References Cited

U.S. PATENT DOCUMENTS

| | | | | |
|---|---|---|---|---|
| 1,600,160 | A | 9/1926 | Batholome | |
| 2,147,499 | A * | 2/1939 | Ross | 352/23 |
| 2,226,919 | A * | 12/1940 | Gubelman | 235/6 |
| 3,709,085 | A * | 1/1973 | Del Castillo | 84/166 |
| 2009/0010477 | A1* | 1/2009 | Frobisher | 381/386 |
| 2009/0241759 | A1* | 10/2009 | Natsume et al. | 84/633 |
| 2012/0089348 | A1* | 4/2012 | Perlin et al. | 702/41 |
| 2013/0275057 | A1* | 10/2013 | Perlin et al. | 702/41 |
| 2013/0319137 | A1* | 12/2013 | Grau et al. | 73/862.381 |
| 2014/0247219 | A1* | 9/2014 | Pedersen et al. | 345/168 |
| 2014/0364218 | A1* | 12/2014 | Holmgren et al. | 463/31 |

* cited by examiner

*Primary Examiner* — Marlon Fletcher
(74) *Attorney, Agent, or Firm* — Jesus Sanchellma, Esq; Christain Sanchelima, Esq.

(57) ABSTRACT

A musical device that includes a housing with a flat top over which a band slides, in both directions, and co-acts with a sensor assembly to detect perforations on the band having predetermined lengths. An electronic simulated musical instrument assembly with inputs adapted to detect each of the sensed coded elements outputs to generate a note or sound for one or more electronically simulated instruments that in turn are amplified and connected to speaker output assemblies. Two or more instruments can play simultaneously and the melody accompaniment, base and percussion performed by the instruments can be changed at any time. A method for playing notes backward without distortion.

5 Claims, 5 Drawing Sheets

BAND DRIVEN ELECTRONIC ORGAN

BACKGROUND OF THE INVENTION

1. Field of the Invention

The present invention relates to a musical instrument and, more particularly, to an electronic organ with a manually driven band.

2. Description of the Related Art

Several designs for musical instruments have been designed in the past. None of them, however, include a manually driven band with perforations for selectively actuating note sensors that permit the band to move forward as well as backwards to play the notes in both directions.

It is a known practice for disk jockies (DJs) to "scratch" the vinyl sound recording to mix sounds with the music being played. See generally en.wikipedia.org/wiki/Scratching (last visited on Oct. 11, 2013). With the original vinyl records a DJ would cause the record to play backwards (temporarily) purportedly enhancing the beat of the music. Independently from the timing of the resulting sound, the notes are not played backwards but rather awkward sounds are generated. This practice is more difficult to implement with compact discs (CDs) and impossible with other digital music formats (MP3s, etc.) thus requiring elaborate "scratching" software to be developed. The present invention provides a novel feature for scratching with true selective playback capabilities of the notes and sounds preprogrammed on a driving band.

Applicant believes that the closest reference corresponds to U.S. Pat. No. 1,600,160 issued to Bartholome for a pneumatic playing device for musical instruments. Bartholome's device includes a band that is used to actuate the note sensors. However, it differs from the present invention because it cannot play the sequence of songs backwards and is not capable of playing several instruments simultaneously. As it will be shown below, the present invention also permits a user to play different instruments simultaneously, change instruments at any time or selectively silence one or more of these instruments.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a musical instrument that allows a user to play a sequence of notes sequentially and in reverse.

It is another object of this invention to provide a musical instrument that permits a user to play two or more instruments simultaneously and to selectively change the instruments chosen for the melody, bass and accompaniment.

It is still another object of the present invention to provide a musical instrument that allows a user to separate the melody from the base, the accompaniment and the percussion.

It is yet another object of this invention to provide such an instrument that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 2:
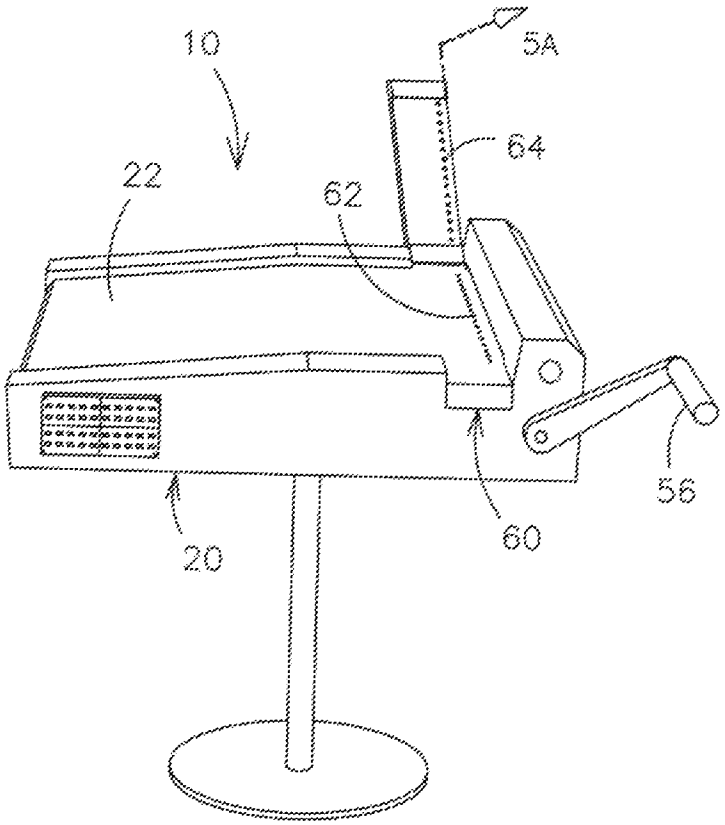
FIG. 2 shows the instrument represented in the previous figure with the pivoting guiding plate raised showing the rows of sensors and light emitting diodes (LEDs) that are cooperatively aligned to come in near opposite physical relationship when the guiding plate is lowered. The band (not shown) passes between the sensors and the LEDs.
Figure 1:
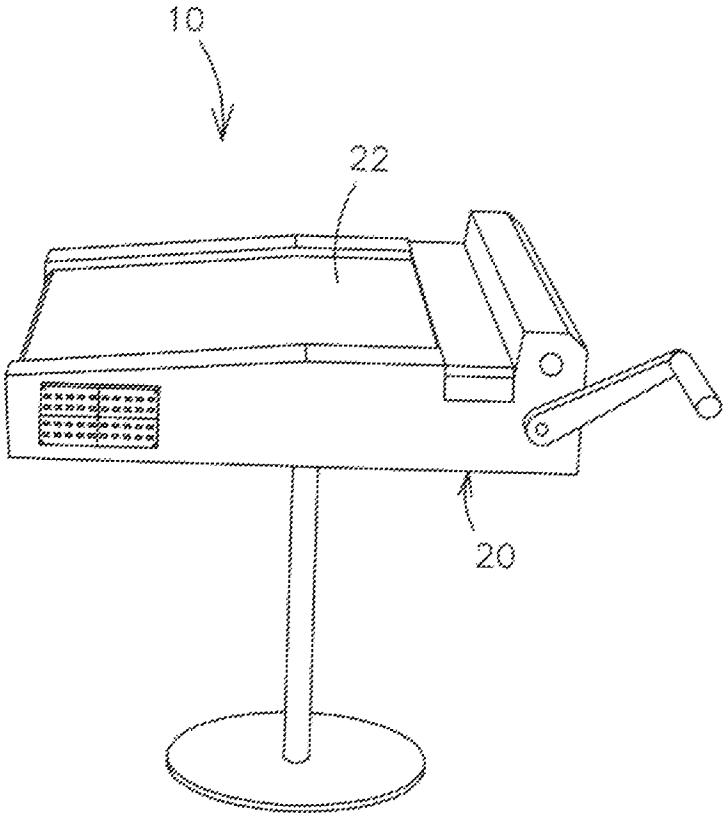
FIG. 1 represents an isometric view of an embodiment for the musical instrument subject of this application.
Figure 3A:
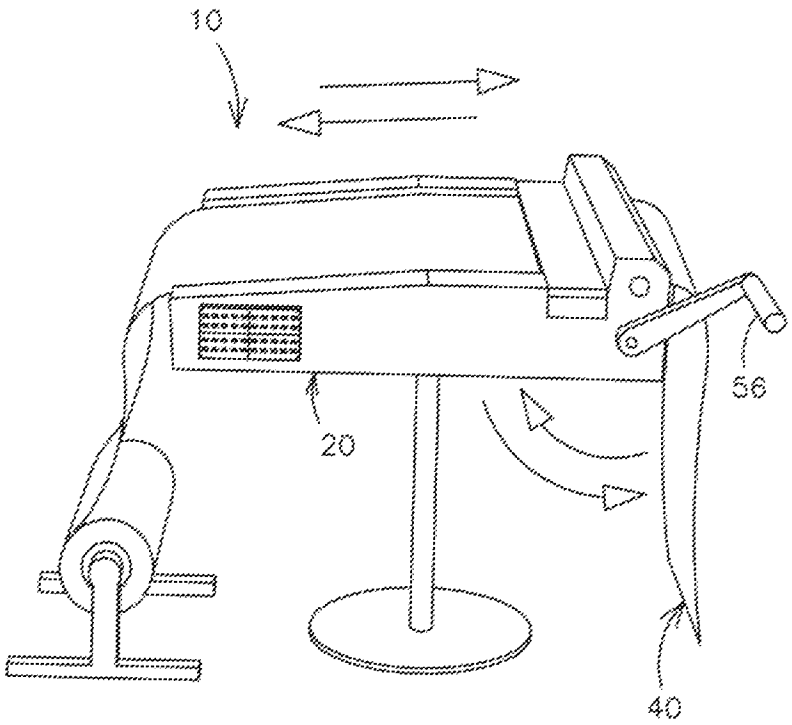
FIG. 3A shows an alternate embodiment for the instrument with a continuous band from a roller.
Figure 3:
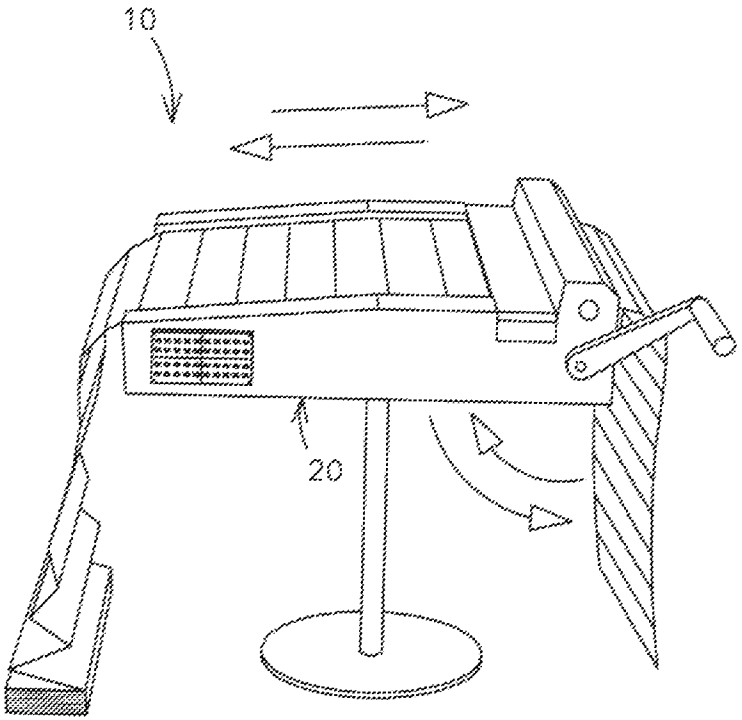
FIG. 3 illustrates the instrument represented in the previous figures with a fan folded band 40 that can move in both directions.

Referring now to the drawings, where the present invention is generally referred to with numeral 10, it can be observed that it basically includes a housing 20 with a flat top 22 over which a coded band 40 slidably travels and is passed through sensor assembly 60 to actuate electronic assembly 80 through input assembly 90 which is part of electronic assembly 80. Keyboard input assembly 88 is also connected to electronic instrument assembly 80 to control the selection of different instruments to be used in the generation of notes and sounds. Output assembly 100 (i.e. speakers) is connected to assembly 80 to generate sound. As seen in FIGS. 1-3 electronic organ 10 stands up to an ergonometrically adjusted height permit a user to operate it.

Band 40 extends longitudinally and is coded with coded elements 42; 43; 44 and 45 that may be implemented with perforations, colored or magnetic markings or other detectable conditioning of the band along predetermined longitudinal distances along band 40, as best seen in FIGS. 3A-3D; 4. The longitudinal length of elements 42; 43; 44 and 45 will determine the length of time a sound (note) is held. Band 40 needs to be flexible and could be made out of paper or plastic.

Sensor assembly 60 is mounted at one end 21 of top 22. Assembly 60 includes a predetermined number of infrared LED'S sensors 62 that are cooperatively positioned to detect coded elements 42. In FIG. 2, sensors 62 are of the type that work with an infrared light source 64 that is detected when coded elements 42 are implemented with perforations in band 40. A mechanical sensor utilizing perforations in band 40 would tend to get stuck obstructing the ability to move band 40 in both directions. The present invention allows a user to practice the "scratching" technique by moving band 40 back and forth, without distortions created from physical manipulation in phonorecords.

The present invention permits a user to do "scratching" without the attendant distortions of phonorecords, CD's and DVD's going back and forth with band 40 of the present invention produces the same sounds without a distortion sound it is the same physical process of interrupting or not the infrared light. For phono records, CD's and DVD's moving back the disc causes distortions since the notes will not be played back. Rather, different sounds are created when the disc is played in reverse.

Figure 3B:
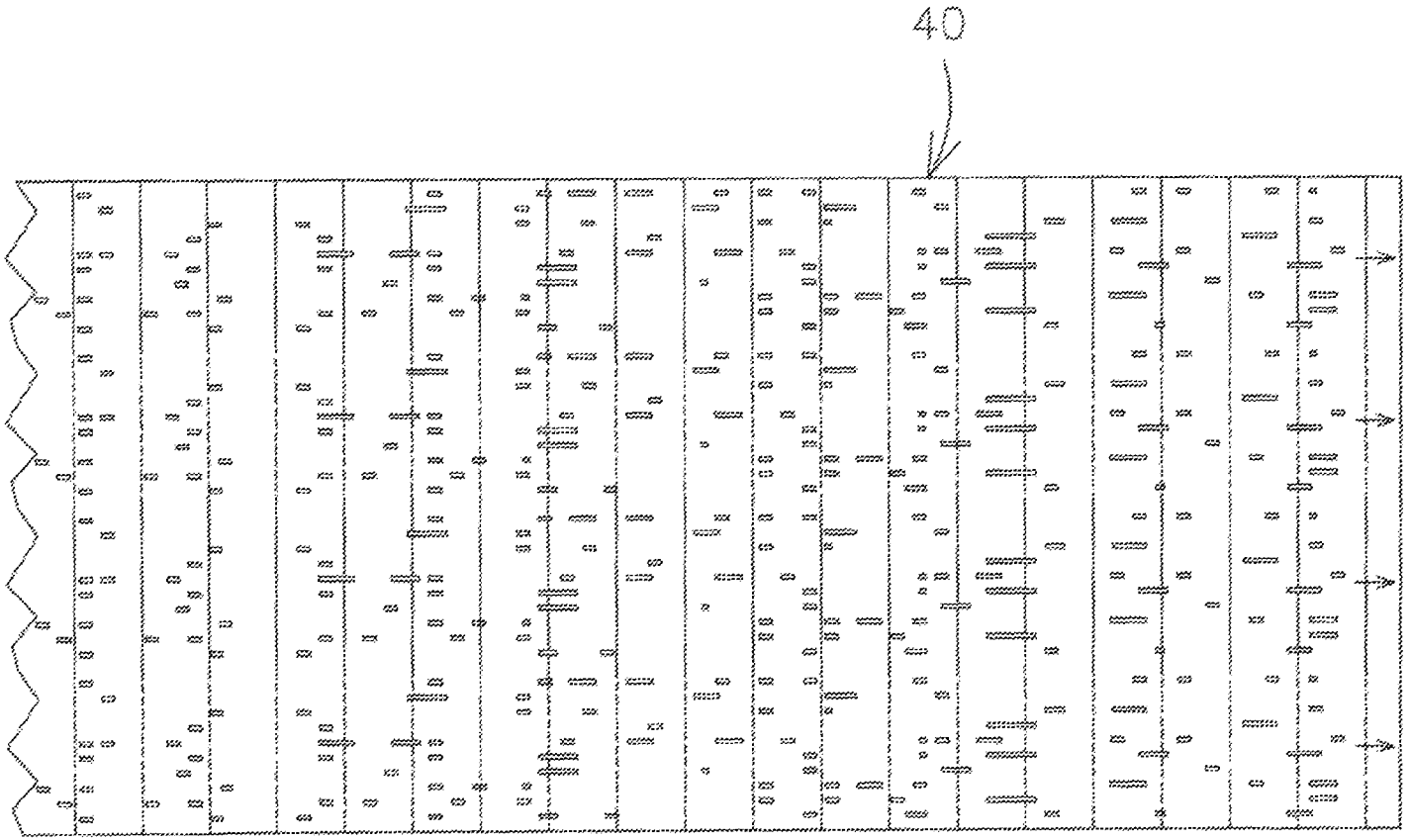
FIG. 3B shows the band used in FIG. 3A with perforations of different lengths (proportional to the time a note or sound held) physically divided preferably in four groups (to facilitate its programming).
Figure 4:
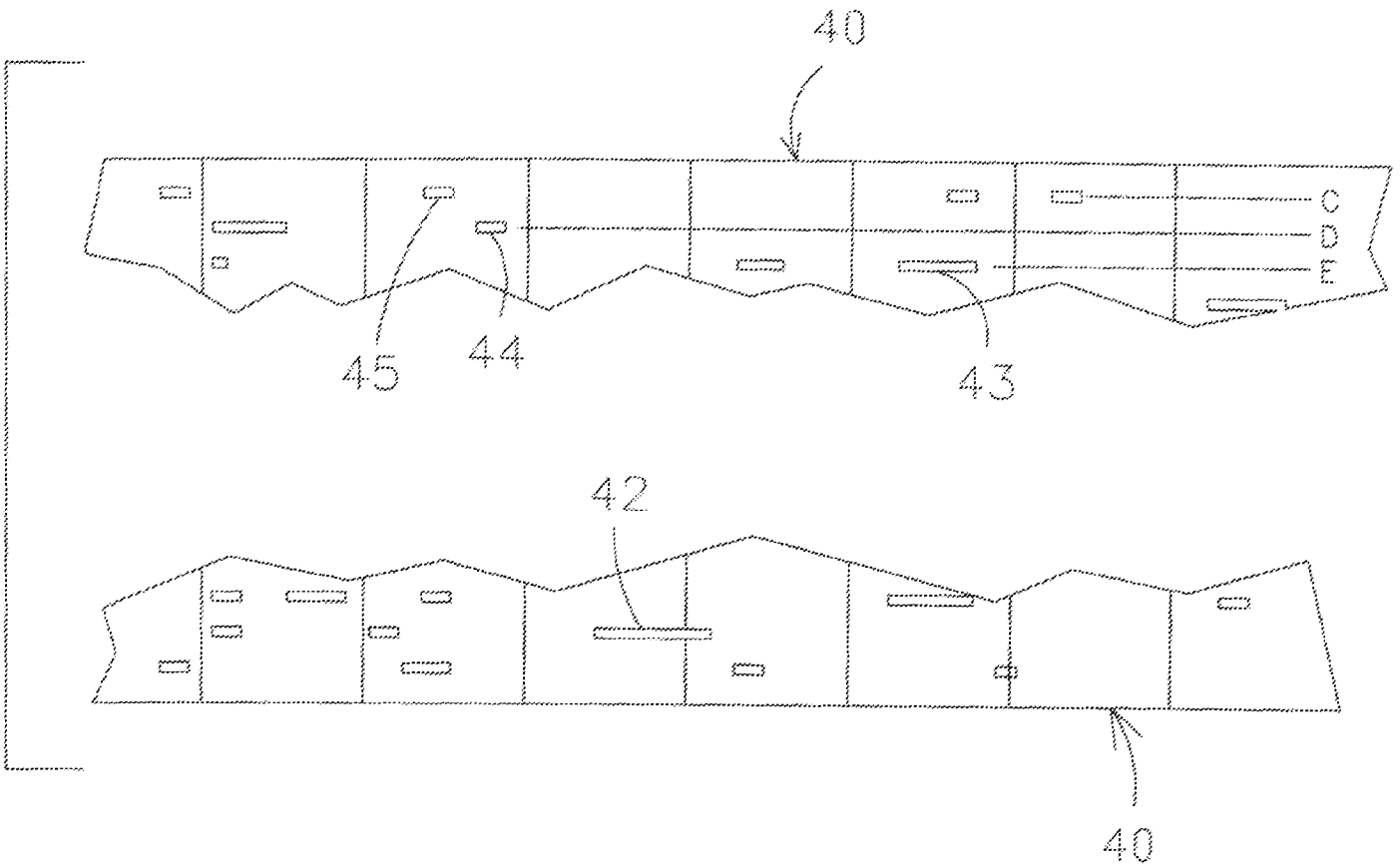
FIG. 4 represents an enlarged portion of the band's outer sides (with the central portion removed) showing perforations of different lengths (holding time) along different lanes (different notes).
Figure 5:
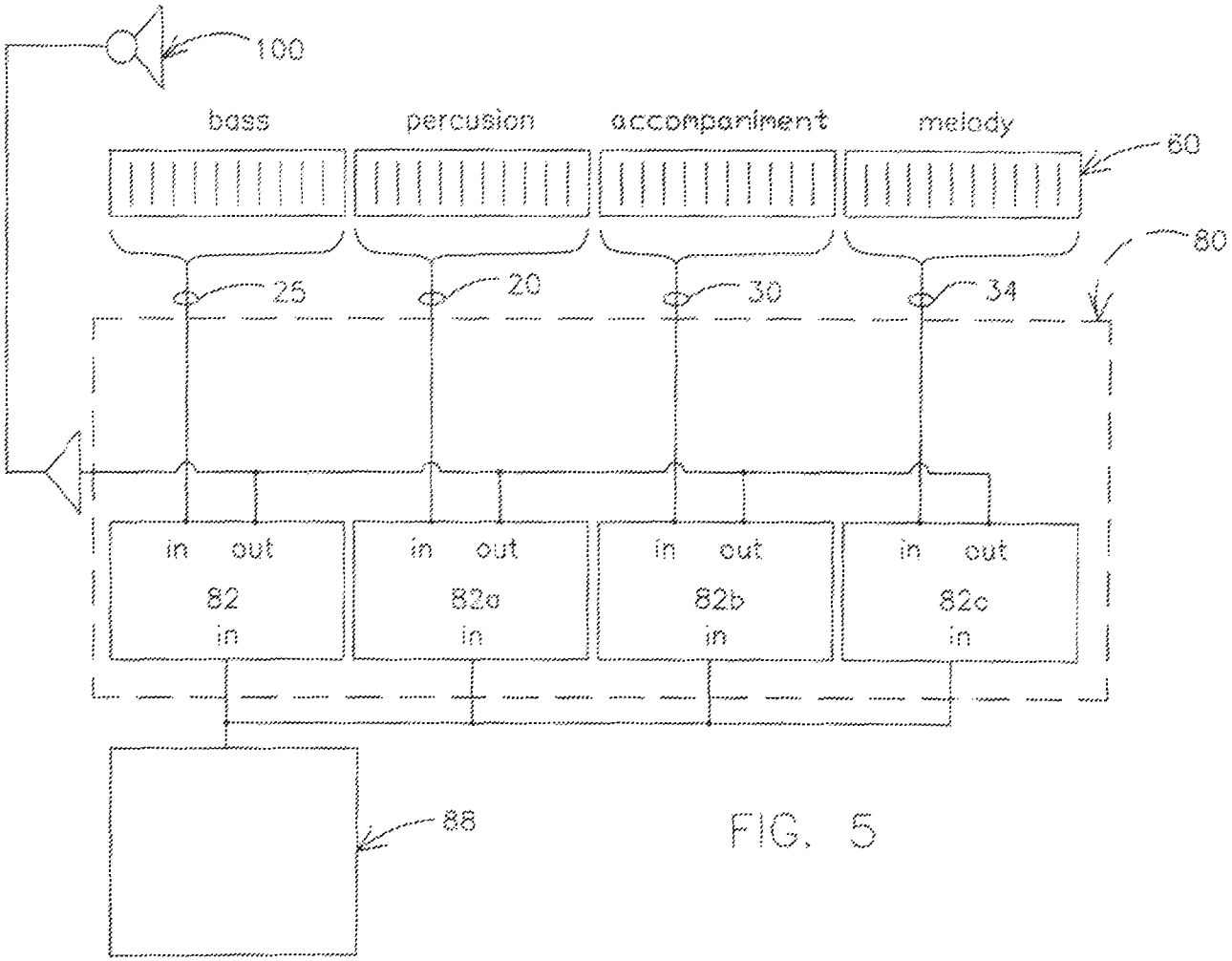
FIG. 5 is a schematic representation of the note sensors wiring connected to a matrix controller that in turn drives the tone generator module in one of the preferred embodiments.

Coded elements 42; 43; 44 and 45 are positioned along longitudinal lines at a parallel and spaced apart relationship with respect to adjacent lines. Each line corresponds to one note. The length of each coded elements 42; 43; 44 and 45 corresponds to the amount of time the note is held. Band 40 is divided in imaginary sections or groups 44 as seen in FIG. 3B to facilitate the programming of coded elements 42. Coded element 42 has, in one of the embodiments, a longitudinal dimension that is twice the length of coded element 43, four times the length of coded element 44 and eight times the length of coded element 45.

Housing 20 included a flat longitudinally extending top 22 over which band 40 slides. Top 22 includes end 21 where sensor assembly 60 is located. Sensor assembly 60 includes a predetermined number of sensors 62 that are cooperatively positioned to detect coded elements 42; 43; 44 and 45. If perforations are used for these coded elements, for example, a source of light opposite to sensors 62 is selectively blocked or allowed to reach sensors 62. Sensors 62 are connected through independent lines for each of the sensors 62 to input assembly 90.

In one of the embodiments, electronic assembly 80 includes four electronic musical instrument assemblies 82; 82*a*; 82*b* and 83*c*, as seen in FIG. 6. These electronic musical instruments can be implemented with model CTK-1100 manufactured by Casio Computer Co., Ltd., 6-2, Hon-machi 1-chome, Shibuya-ku, Tokyo 151-8543 Japan. The Casio device, like other commercially available devices, produces a predetermined number of notes and sounds for electronically simulated instruments (wind, string, etc.). Instrument assembly 82 is used to generate bass notes. Instrument assembly 82*a* is used to generate melody notes. Instrument assembly 82*b* is used to provide the accompanying notes. Instrument 82*c* provides the percussion sounds and other sounds. The generation of these notes and sounds by instrument assemblies 82; 82*a*; 82*b* and 83*c* are part of what is referred to as electronic assembly 80. The keyboard input for the notes and sounds in Casio's commercially available electronic instrument has been replaced with inputs of sensor assembly 60. In this manner, what is driving instruments 82; 82*a*; 82*b* and 83*c* originates from the signal of sensors 62 instead of keys in a keyboard. The controls for the different musical instruments and rhythms are provided through keyboard input assembly 88. In one of the embodiments, assembly 88 has its keys divided in four types so that user may select different instruments for the melody accompaniment, percussion and bass that will be played, at any given time, as band 40 is passed through sensor assembly 60.

Band 40 includes, in one of the embodiments, 109 lines of coded elements divided in four groups, as best seen in FIG. 3B. These four groups are bass, percussion, accompanying music, and melody. For the melody group 34 lines are reserved in this embodiment for 34 musical notes. The accompaniment group has 30 lines with their respective notes. For the bass group there are 20 lines with 20 notes. And for the percussion group there are 25 lines, each corresponding to one instrument.

With the present invention a user can program band 40 to play the music in each band group with different instruments and for the percussion group with more than on instrument simultaneously. Additionally band 40 can be moved by sensor assembly 60 at a speed that is controlled by a user and the direction of travel can also be easily changed. The versatility of the instrument allows a user to create innovative sounds.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An electronic musical device, comprising:

A) a housing including a longitudinally extending top with first and second end;

B) a longitudinally extending band having first and second surfaces and including a first plurality of longitudinal parallel and spaced apart lines of separate perforations, each of said lined perforations representing a note or a sound and each having one of a plurality of a predetermined lengths to define the time the note or sound is held said first surface coming in sliding, and abutting contact with said top;

C) a sensor assembly having a light source projected to said first surface and a corresponding first plurality of photo sensors for each of said lines, said sensor assembly mounted to said top facing said second surface and coacting with said perforations and light source as the band longitudinally slides, forward and backward, over said top to sense said light source and the length of each of said perforations generating an output signal for each of said photo sensors detecting said light source; and D) an electronic musical instrument assembly for generating notes and sounds based on said output signal and corresponding to at least one of a plurality of electronically simulated instruments, each having a corresponding first plurality of inputs, and said electronic musical instrument assembly having a second input assembly for selecting at least one of said second plurality of electronically simulated instruments, and said electronic musical instrument assembly further including an output speaker assembly.

2. The electronic musical instrument set forth in claim 1 wherein said band includes at least two groups of lined perforations corresponding to the melody and the accompaniment notes, respectively, of a musical work, said sensor assembly includes at least two corresponding groups of photo sensors with corresponding output signals and said instrument assembly includes at least two groups of corresponding first plurality of inputs so that at least two simulated instruments can be simultaneously activated.

3. The electronic musical instrument set forth in claim 2 wherein said first plurality of lines of separate perforations are divided in three groups corresponding to the melody notes, the accompaniment notes and the bass notes of a musical work.

4. The electronic musical instrument set forth in claim 2 wherein said first plurality of lines of separate perforations are divided in three groups corresponding to the melody notes, the accompaniment notes, the bass notes and the percussion sounds of a musical work.

5. The electronic musical instrument set forth in claim 1 wherein said light source is in the infrared range and said photo sensors are infrared sensors.

* * * * *